United States Patent [19]

de Larosiere

[11] Patent Number: 4,518,081

[45] Date of Patent: May 21, 1985

[54] MULTI-UNIT TEAR-AWAY CONTAINER CARRIER

[76] Inventor: Pierre J. de Larosiere, 30 Duque de Palmela, 4C, 1200 Libson, Portugal

[21] Appl. No.: 467,965

[22] Filed: Feb. 18, 1983

[51] Int. Cl.[3] ..... B65D 75/00

[52] U.S. Cl. ..... 206/158; 206/602; 206/614; 294/87.2

[58] Field of Search ..... 206/144–161, 206/199, 602, 605, 608, 609, 611, 612, 616, 617, 820, 614; 220/23.4; 294/87.2

[56] References Cited

U.S. PATENT DOCUMENTS

| | | | |
|---|---|---|---|
| 3,038,602 | 6/1962 | Rapata | 206/612 |
| 3,224,575 | 12/1965 | Whiteford | 206/151 |
| 3,246,796 | 4/1966 | Englander et al. | 206/602 |
| 3,540,582 | 11/1970 | Wood | 206/612 |

FOREIGN PATENT DOCUMENTS

| | | | |
|---|---|---|---|
| 2348858 | 4/1975 | Fed. Rep. of Germany | 206/602 |

*Primary Examiner*—George E. Lowrance
*Assistant Examiner*—Jimmy G. Foster
*Attorney, Agent, or Firm*—Dennis H. Lambert

[57] ABSTRACT

A multi-unit tear-away container carrier has a plurality of flanged openings therethrough for gripping and holding in spaced relationship the upper ends of a plurality of containers to form a package of the containers. Tear strips are formed in the carrier, dividing the carrier into a plurality of sections each having a plurality of flanged openings therethrough for holding a plurality of containers. One section may be removed to separate a secured-together plurality of containers from the package, or a plurality of sections may be removed together to separate a larger number of secured-together containers from the package.

4 Claims, 6 Drawing Figures

FIG 1
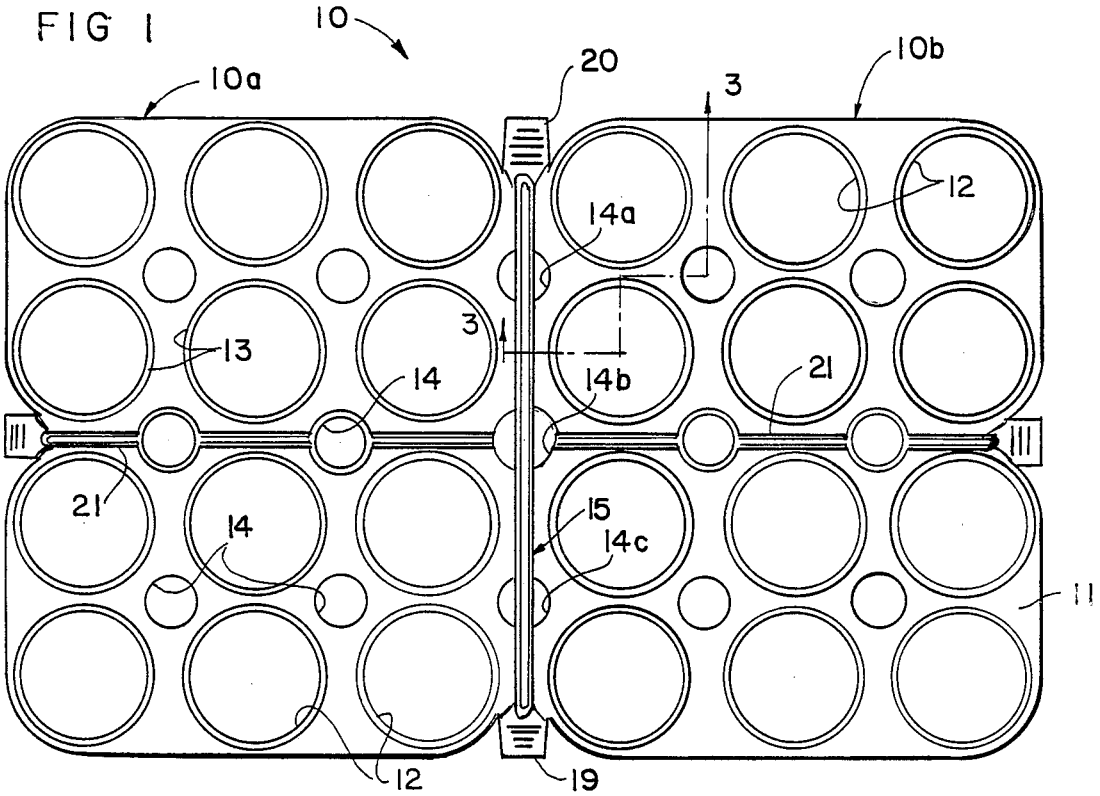
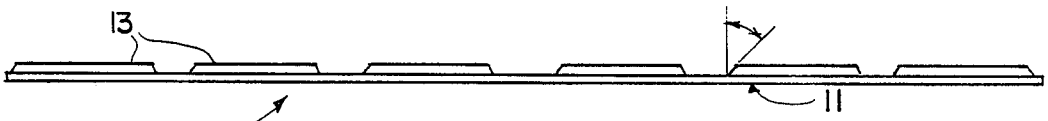
FIG 2
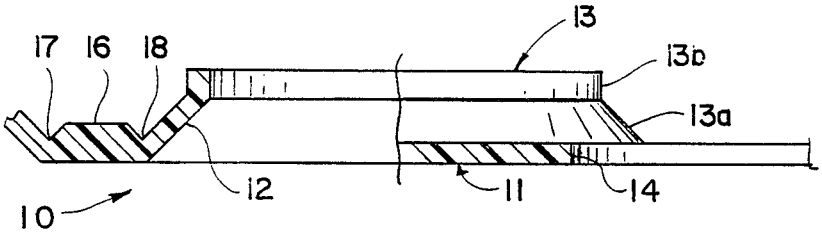
FIG 3
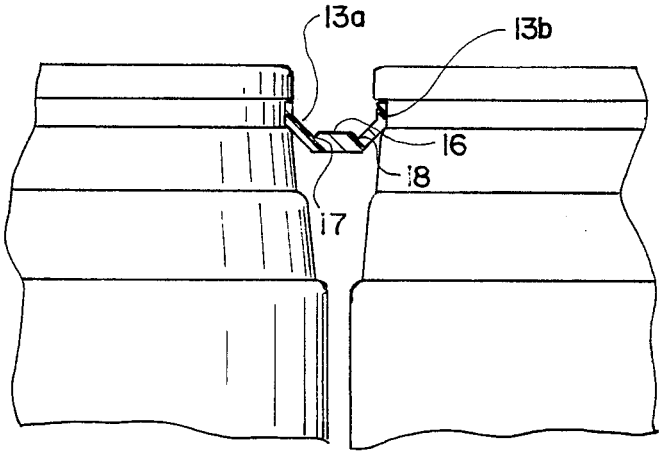
FIG 4

FIG 5
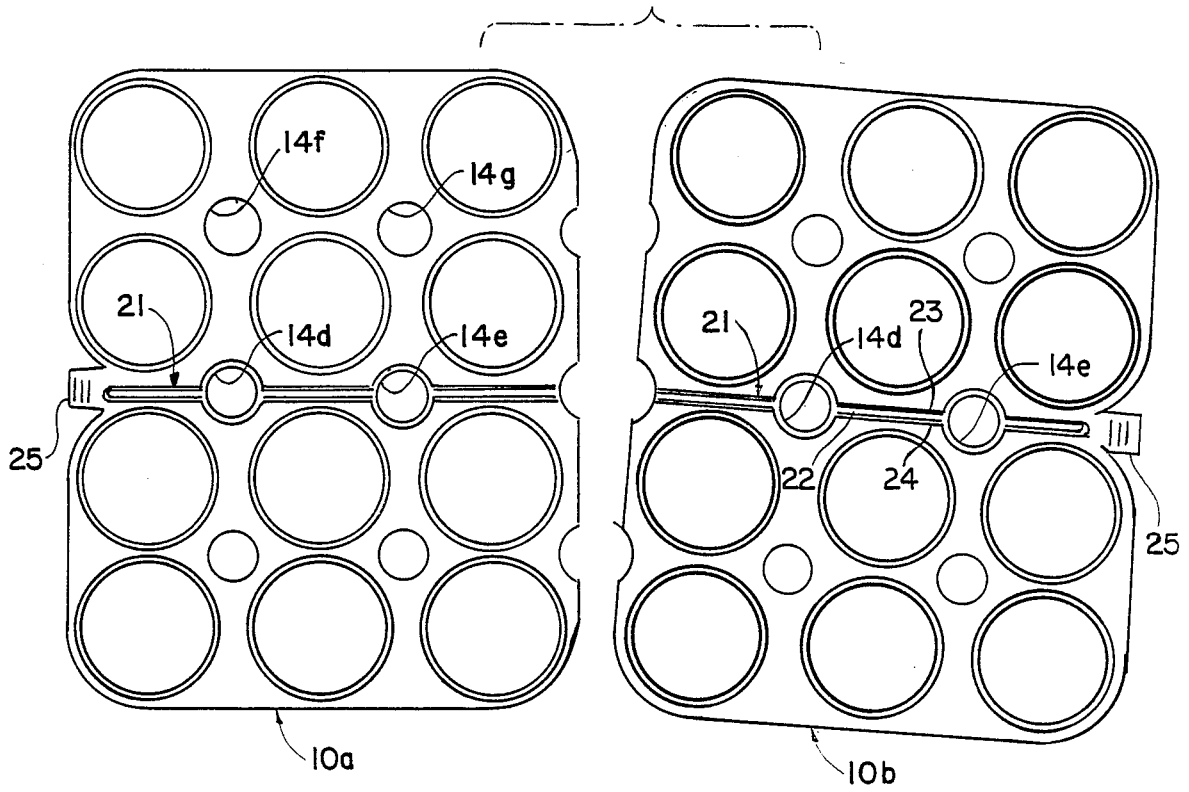
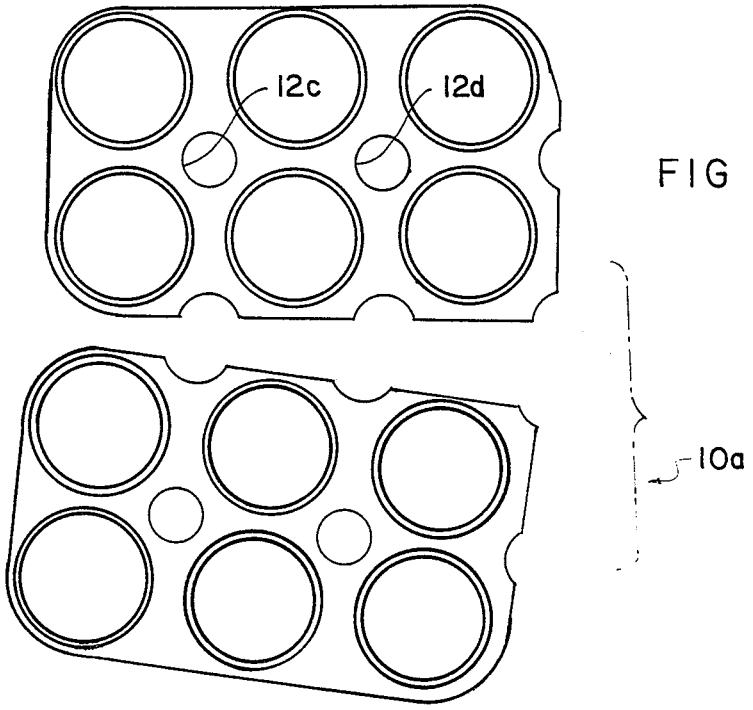
FIG 6

MULTI-UNIT TEAR-AWAY CONTAINER CARRIER

BACKGROUND OF THE INVENTION

1. Field of the Invention

This invention relates generally to packages for packaging together a plurality of containers. More particularly, the invention relates to a container carrier which engages and holds in spaced relationship the upper ends of a plurality of containers, such as beverage cans.

2. Prior Art

Various carrier designs are known in the prior art for engaging and holding a plurality of containers in a package. For instance, separators made of plastic film with apertures through which the ends of containers are received are commonly used. Typical examples are found on "six packs" of beer or soft drink cans. Other designs include printed cartons or boxes which generally hold either six or twelve cans, and plastic shrink wrap around groups of six or twelve cans.

U.S. Pat. Nos. 3,250,564 and 3,515,272 disclose plastic films which engage and hold the upper ends of a group of cans and serve as carriers for carrying the unit or package of cans.

U.S. Pat. No. 3,540,582 discloses one form of box or carton type carrier, in which sub-cartons or secondary packages each containing a number of bottles are held in assembled relationship inside a wrapper which may be separated into sub-sections to expose the secondary packages. It appears from the disclosure in this patent that 24 bottles are assembled as a group inside the wrapper. The assembled bottles are, in turn, assembled in sub-groups of six bottles each inside secondary packages held together by the wrapper.

With the possible exception of U.S. Pat. No. 3,540,582, discussed above, the prior art carriers are designed exclusively for one specific group of containers, i.e. either 12 or 6. Thus, brewers or bottlers must prepare their production lines for the different groupings of cans, depending upon market demand. Similarly, retailers need to maintain stocks or inventory of each different configuration in order to satisfy demand for each type. It is difficult to predict what the demand will be and this results in the need to carry larger inventories, some of which are slow moving items or which have relatively short shelf life.

The basic package commonly used in the industry comprises 24 cans or bottles held assembled together by one of a number of package designs, such as cartons, trays, shrink wraps, etc. These 24-can cartons generally consist of either four "six packs" or two "twelve packs". As noted previously, the "six packs" and "twelve packs" are assembled by preparing the production lines at the bottler or brewer location for the specific package desired and then placing the appropriate number of "six packs" or "twelve packs" in a carton for handling and shipping. The retailer then typically removes the "six packs" or "twelve packs" from the cartons and displays them for sale. As noted previously, this requires maintenance of large inventories and extra handling.

In an effort to provide greater flexibility to the consumer in terms of the number of containers which he may conveniently select and carry, and yet still enable the retailer to display packages containing a number of cans or bottles, the industry has developed several package designs which permit one or more cans or bottles to be separated from the basic package by the consumer at the point of sale. Such designs are exemplified by U.S. Pat. Nos. 3,300,041, 3,759,378 and 3,948,388, all of which show carriers or holders for a plurality of cans in which separating means or tear lines and the like are provided to enable individual cans or sub-assemblies of cans to be separated from the basic package. U.S. Pat. Nos. 3,515,272 and 3,540,582, discussed previously also disclose this basic concept.

All of these prior art devices either require the use of multiple package devices, i.e., a first holder or secondary package which secures together a number of containers which are then held assembled by a primary package or wrap, or individual cans are held to a separable holder by means of adhesive or the like. In either event, the bottler or brewer must prepare his production line for assembling the particular secondary package desired, e.g., either "six packs" or "twelve packs". The use of multiple package designs or wraps necessitates extra handling, cost and waste.

PURPOSE OF THE INVENTION

It is, therefore, a primary object of this invention to provide a lightweight, inexpensive package for holding together a plurality of containers for storage, handling and display and which is separable into different sections to enable a consumer to separate a sub-assembly of containers from the package.

Another object of the invention is to provide a package for grouping together a basic number of containers so that production lines can be prepared to assemble together that number of containers and yet, at the point of sale, the consumer may select either that number by taking the complete package or sub-packages may be separated from the basic package, the sub-packages containing a desired number of containers as selected by the consumer.

A further object of the invention is to provide a package for grouping together a number of containers in a container carrier, in which the container carrier may be separated into a number of container sub-carriers each holding a number of containers as selected by a consumer.

A more specific object of the invention is to provide a container carrier of injection molded plastic material which has a plurality of container-gripping openings therethrough for holding a number of containers in a package, and which has tear strips formed therein to separate the carrier into a number of sub-carriers holding either six or twelve containers, depending upon which tear strip is removed, and which has a number of finger holes disposed between the openings to enable either the complete container carrier or one of the sub-carriers to be grasped and carried with the selected number of containers held thereby.

A still further object of the invention is to provide a container carrier which has tear strips formed therein for enabling the carrier to be separated into a number of sub-carriers, with finger holes formed in the carrier to enable the carrier or one of the sub-carriers to be grasped and carried with the fingers, and one of the tear strips comprising a continuous rib functioning as reinforcing for at least some of the finger holes.

SUMMARY OF THE INVENTION

These objects and other advantages of the invention are accomplished by the carrier as described herein.

The carrier comprises a flat sheet with a plurality of openings therethrough defined by tapered flanges which engage and hold the rims of cans inserted through the openings. The carrier preferably has 24 openings therethrough so that 24 cans can be assembled into a basic package, and the flanges are tapered to guide the cans into the openings and enable easy insertion of the cans through the openings. A first tear strip extends transversely of the carrier, dividing the carrier into two sub-assemblies of 12 openings each. Thus, a consumer may grasp and remove the first tear strip to separate from the basic package of sub-package of 12 cans. A second tear strip extends longitudinally of the carrier and when this tear strip is removed, the twelve-pack sub-package is further divided into two six-packs. Finger holes are strategically located in the carrier so that at least a pair of finger holes are provided for carrying either the entire package or the twelve- or six-pack sub-package provided by removing one or both of the tear strips, as desired.

BRIEF DESCRIPTION OF THE DRAWINGS

Other objects of the invention will appear in the following description and appended claims, reference being made to the accompanying drawings forming a part of the specification, and wherein like reference characters designate corresponding parts in the several views.

FIG. 1 is a top plan view of the carrier according to the invention;

FIG. 2 is a side view in elevation of the carrier of FIG. 1;

FIG. 3 is a greatly enlarged, detailed sectional view in elevation, taken along line 3—3 in FIG. 1;

FIG. 4 is a greatly enlarged, somewhat schematic sectional view in elevation, showing the manner in which the tapered flanges surrounding the openings grip the underside of the rim of a container inserted through the opening; and FIGS. 5 and 6 are schematic plan views showing removal of sub-packages of twelve and six containers, respectively.

DESCRIPTION OF THE PREFERRED EMBODIMENTS

Referring more specifically to the drawings, the carrier according to the invention is referred to generally at 10 and comprises a substantially flat sheet 11 having a plurality of openings 12 therethrough. Each opening is defined or surrounded by an upstanding, tapered flange 13 having a first part 13*a* inclined at an angle of about 45° and a second part 13*b* defining a cylindrical gripping portion.

A plurality of finger holes 14 are formed in the carrier, with a finger hole being disposed in each area between each four adjacent openings 12.

A first tear strip 15 extends transversely of the carrier and comprises a continuous rib 16 having score lines or frangible portions 17 and 18 extending along each side thereof. It will be noted that the tear strip extends completely across the width of the carrier, and even bridges three holes 14*a*, 14*b* and 14*c* formed along the transverse centerline of the carrier. Finger tabs 19 and 20 are provided on the opposite ends of the tear strip 15 whereby the tear strip 15 may be grasped and removed to separate one half 10*a* of the carrier from the other half 10*b*. Each half has twelve openings therethrough, so that removal of the tear strip 15 results in two "twelve packs".

As best seen in FIGS. 1 and 5, a pair of finger holes 14*d* and 14*e* are uniformly spaced along the centerline of each "twelve pack" 10*a* and 10*b* to enable the twelve pack to be carried by inserting the fingers through the finger holes.

A second tear strip 21 extends along the centerline of each twelve pack and comprises a continuous rib 22 having score lines of frangible portions 23 and 24 extending along opposite sides thereof. The tear strp 21 is interrupted at the center of the carrier, as best seen in FIGS. 1 and 5, terminating at the edge of a finger hole 14*b* in the center of the carrier. A finger tab 25 is at the outer end of the tear strip 21 in each "twelve pack" half of the carrier. The tear strip 21 extends continuously around the periphery of the finger holes 14*d* and 14*e* on the centerline of each twelve-pack half of the carrier, and comprises reinforcement for these finger holes.

In use, the bottler or brewer may prepare his production line for assembling 24 cans and the carrier 10 of the invention attached thereto by pushing it down over the upper ends of the cans, for example. The resultant package may then be assembled with any suitable carton, tray or wrap, including applicant's tray which prevents abrasion between adjacent cans, and shipped to retail outlets or distributors. The complete 24-can carton or package may then be displayed at the point of sale, and the consumer may select either a "twelve pack" or a "six pack" by tearing off one or both of the tear strips 15 and 21. In any of the resultant configurations, a cohesive, unitary package is provided, which is easy to carry. In other words, the entire 24-can package can be carried by inserting the fingers through the four finger holes 14*d*, 14*e* and 14*d*, 14*e* along the centerline of the carrier, or, a "twelve pack" half can be carried by inserting the fingers through one of the pairs of holes 14*d* and 14*e*, or, a "six pack" can be carried by inserting the fingers through the pair of finger holes 14*f* and 14*g* in each "six pack" portion of the carrier.

While the carrier has been described in detail, it is obvious that the invention is not to be limited to the exact form disclosed, and that changes in detail and construction may be made therein within the scope of the invention, without departing from the spirit thereof.

Having thus set forth and disclosed the nature of this invention, what is claimed is:

1. A multi-unit tear-away container carrier, comprising:

a substantially flat sheet having a plurality of substantially uniformly distributed flanged openings therethrough for gripping and holding in spaced relationship the upper ends of a plurality of containers;

at least one tear strip formed in the sheet, defining sections of the carrier separable from one another, each section having at least one flanged opening therethrough for holding at least one container; and said carrier having a plurality of finger holes therein, disposed to enable any section of the carrier or the entire carrier to be lifted and carried by grasping appropriate pairs of finger holes, said tear strip extending around and forming a reinforcement to at least some of said finger holes.

2. A multi-unit tear-away container carrier as defined in claim 1, wherein:

the sheet has a longitudinal dimension and a transverse dimension and a first tear strip extends along the transverse centerline of the sheet and a second tear strip extends along the longitudinal centerline of the sheet, dividing the carrier into halves and quarters, respectively.

3. A multi-unit tear-away container carrier as defined in claim 2, wherein:

the sheet has a plurality of finger holes in said sheet are formed therein, distributed uniformly with respect to the flanged openings, and including at least a pair of finger holes in each half formed when the first tear strip is removed and a pair of finger holes in each quarter formed when the second tear strip is also removed, whereby a cohesive, easily carried package is provided in each configuration.

4. A multi-unit tear-away container carrier as defined in claim 3, wherein:

the first tear strip is continuous across the width of the carrier and the second tear strip is discontinuous along the length of the carrier, said second tear strip being interrupted at approximately the midpoint of its length.

* * * * *